US009103074B1

(12) United States Patent
Urmson, Jr. et al.

(10) Patent No.: US 9,103,074 B1
(45) Date of Patent: Aug. 11, 2015

(54) MODULAR INSULATED TIE PLATE

(71) Applicant: Koppers, Inc., Pittsburgh, PA (US)

(72) Inventors: William Thomas Urmson, Jr., Valencia, PA (US); John W. Mospan, Pittsburgh, PA (US)

(73) Assignee: Koppers Delaware, Inc., Wilmington, DE (US)

( * ) Notice: Subject to any disclaimer, the term of this patent is extended or adjusted under 35 U.S.C. 154(b) by 255 days.

(21) Appl. No.: 13/723,264

(22) Filed: Dec. 21, 2012

(51) Int. Cl.
*E01B 9/00* (2006.01)
*E01B 9/68* (2006.01)
*B23P 11/00* (2006.01)

(52) U.S. Cl.
CPC .. *E01B 9/68* (2013.01); *B23P 11/00* (2013.01)

(58) Field of Classification Search
CPC ..... E01B 11/02; E01B 11/10; E01B 11/54; E01B 9/40; E01B 9/42; E01B 9/68; E01B 9/303; E01B 9/36; E01B 9/683; E01B 9/685; E01B 9/686; E01B 9/38; E01B 9/483; E01B 9/18; E01B 9/00; E01B 26/00; E01B 5/02
USPC ..... 238/283, 287, 264, 151, 152, 349–351
See application file for complete search history.

(56) References Cited

U.S. PATENT DOCUMENTS

| | | | | |
|---|---|---|---|---|
| 4,971,247 | A * | 11/1990 | Harkus | 238/283 |
| 5,110,046 | A * | 5/1992 | Young | 238/283 |
| 5,203,502 | A * | 4/1993 | Young | 238/283 |
| 5,335,850 | A * | 8/1994 | Igwemezie | 238/283 |
| 5,692,677 | A * | 12/1997 | Duconseil | 238/283 |
| 6,342,287 | B1 * | 1/2002 | Kaczmarek et al. | 428/156 |
| 6,986,470 | B2 * | 1/2006 | Osler | 238/264 |
| 7,261,244 | B2 | 8/2007 | Urmson, Jr. et al. | |
| 7,690,584 | B2 * | 4/2010 | Geissele et al. | 238/264 |
| 8,042,747 | B2 | 10/2011 | Mospan et al. | |
| 8,113,441 | B2 | 2/2012 | Urmson, Jr. et al. | |
| 2004/0155117 | A1 * | 8/2004 | Urmson et al. | 238/287 |
| 2006/0027674 | A1 * | 2/2006 | Urmson et al. | 238/243 |
| 2006/0043205 | A1 * | 3/2006 | Nevins | 238/283 |
| 2006/0243818 | A1 * | 11/2006 | Urmson et al. | 238/152 |
| 2007/0235551 | A1 * | 10/2007 | Ellerhorst | 238/283 |
| 2008/0083836 | A1 * | 4/2008 | Urmson et al. | 238/151 |
| 2009/0108086 | A1 * | 4/2009 | Mospan et al. | 238/287 |
| 2010/0270386 | A1 * | 10/2010 | Mospan et al. | 238/152 |
| 2011/0068185 | A1 * | 3/2011 | Bosterling et al. | 238/283 |
| 2012/0187207 | A1 * | 7/2012 | Cox et al. | 238/283 |
| 2014/0076980 | A1 * | 3/2014 | Urmson et al. | 238/125 |

* cited by examiner

*Primary Examiner* — Jason C Smith
(74) *Attorney, Agent, or Firm* — The Webb Law Firm

(57) ABSTRACT

A tie plate assembly including a tie plate, an insulator plate assembly, and first and second clips configured to secure a rail to the tie plate assembly. The tie plate has a body with a top surface and the insulator plate assembly is positioned on the top surface of the tie plate. The insulator plate assembly includes a top pad and an abrasive plate. The first and second clips comprise an electrically-insulating material.

18 Claims, 7 Drawing Sheets

MODULAR INSULATED TIE PLATE

BACKGROUND OF THE INVENTION

1. Field of the Invention

The present invention relates to an insulated tie plate for bracing and securing a railroad rail.

2. Description of Related Art

A rail system is generally divided into sections or blocks for detecting trains which permit more trains to travel on one stretch of track or railroad rails. Each section is electrically isolated from all other sections so that when no train is present, a high electrical resistance can be measured over the parallel railroad rails in that section. When a train enters the section, the train short circuits adjacent railroad rails and the electrical resistance drops, thus indicating that a train is in that section.

A tie plate, typically made of metal, is used to secure a railroad rail against lateral, rotational, and vertical movements. Railroad rails are generally joined to each other by welding each end or by attaching the ends using a steel rail joint. Electrically isolating the joined rails from each other is necessary for signaling and other control functions. When two railroad rail sections are joined using a typical metal tie plate, electrical isolation of the railroad rail sections may not occur because the current will pass from one railroad rail section through the tie plate and then to the adjacent railroad rail section. Non-metallic insulating tie plates are sometimes utilized, but are generally expensive because of the special high-performance materials needed to endure the high tensile and flexural forces acting on the railroad rail. Thus, metallic tie plates having a coating of electrically-insulating material is utilized. The electrically-insulating material, however, will wear after a period of use and may cause undesired shorting between the rails and the tie plate. The electrically-insulating material will need to be replaced or the metallic tie plate having the electrically-insulating coating will need to be replaced.

Referring to FIG. 1, a conventional tie plate assembly 1 includes a tie plate 2 that defines a recessed portion 4 for receiving a base portion 6 of a rail 8. The recessed portion 4 of the tie plate 2 receives electrically-insulating material in the form of a bottom plate 10 and two side plates 12. The tie plate 2 is secured to a tie (not shown) via fasteners 14. The rail 8 is secured to the tie plate 2 via clips 16 that are secured to the tie plate 2 with fasteners 18. In particular, the clips 16 engage rail joint bars 20 that secure adjacent rail sections to each other. The tie plate assembly 1 is shown in FIG. 15 of U.S. Pat. No. 8,042,747, which is hereby incorporated by reference in its entirety.

DESCRIPTION OF THE PREFERRED EMBODIMENTS

Figure 1:
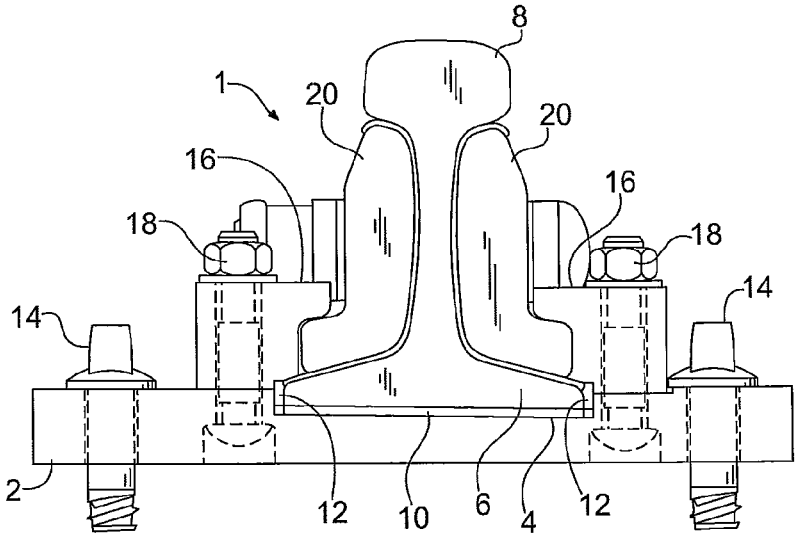
FIG. 1 (PRIOR ART)
FIG. 1 is a side view of a conventional tie plate assembly.

For purposes of the description hereinafter, the words "upward" and "downward", and like spatial terms, if used, shall relate to the described embodiments as oriented in the drawing figures. However, it is to be understood that many alternative variations and embodiments may be assumed except where expressly specified to the contrary. The specific devices and embodiments illustrated in the accompanying drawings and described herein are simply exemplary embodiments of the invention.

Referring to FIGS. 2-9, one embodiment of a tie plate assembly 50 includes a tie plate 52, an insulator plate assembly 54, and first and second clips 56, 58.

Figure 2:
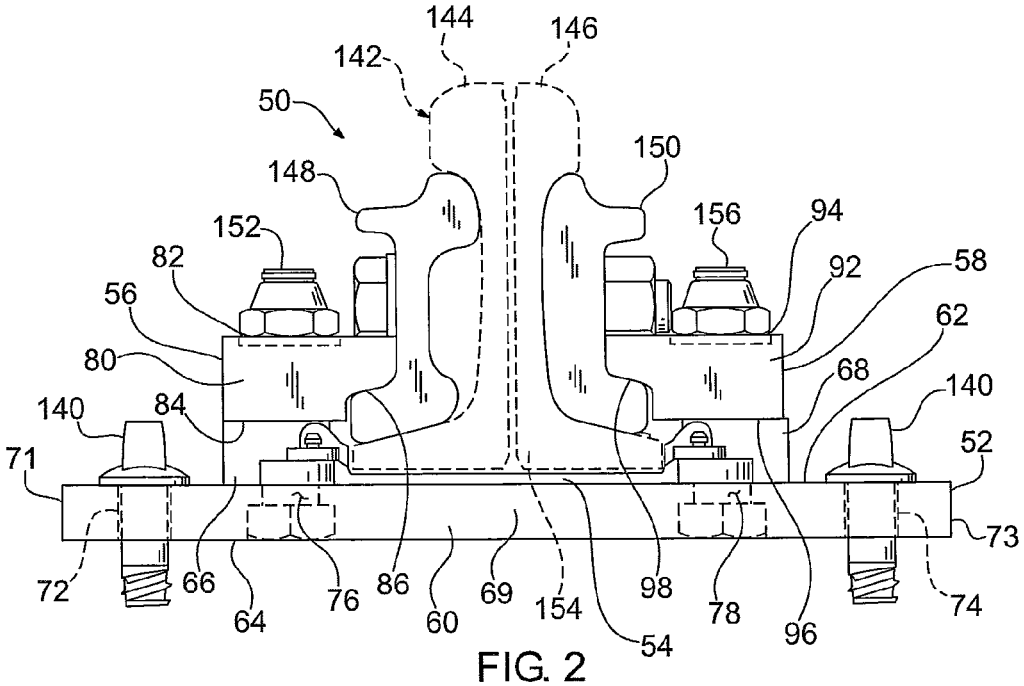
FIG. 2 is a side view of a tie plate assembly according to one embodiment of the present invention.
Figure 4:
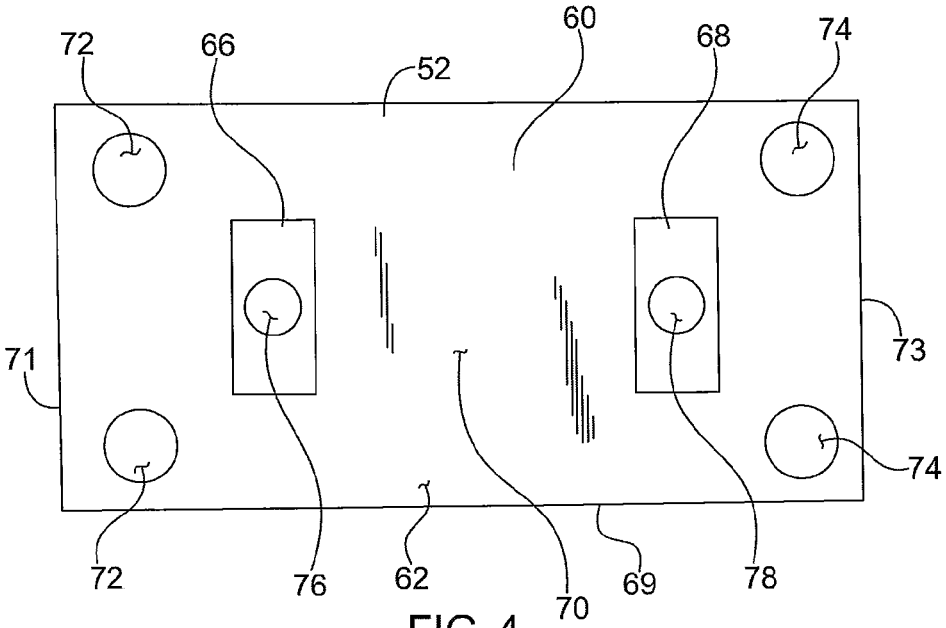
FIG. 4 is a top view of a tie plate of the tie plate assembly shown in FIG. 1 according to one embodiment of the present invention.

Referring to FIGS. 2 and 4, the tie plate 52 includes a body 60 having a top surface 62 and a bottom surface 64 and first and second abutments 66, 68 positioned on the top surface 62 of the body 60. The first and second abutments 66, 68 are spaced apart from each other in a longitudinal direction of the body 60 to define a receiving space 70 therebetween. The first and second abutments 66, 68 are generally rectangular-shaped and extend upwardly from the top surface 62 of the body 60, although other suitable shapes for the abutments 66, 68 may be utilized. The first and second abutments 66, 68 are positioned laterally inward from opposite sides 69 of the body 60 and longitudinally inward from first and second ends 71, 73 of the body 60. The body 60 of the tie plate 52 also defines a first set of securing openings 72 adjacent to the first end 71 of the tie plate 52 and a second set of securing openings 74 adjacent to the second end 73 of the tie plate 52. The first and second abutments 66, 68 and the body 60 of the tie plate 52 also each define a first clip opening 76 and a second clip opening 78. The first and second clip openings 76, 78 are counterbored from the bottom surface 64 of the body 60 of the tie plate 52, although other suitable openings may be utilized. The first and second abutments 66, 68 may be formed separately from the body 60 of the tie plate 52 and fastened to the body 60 via welding or other suitable fastening arrangement or may be formed integrally with the body 60 of the tie plate 52. The body 60 of the tie plate 52 and first and second abutments 66, 68 are manufactured from metal, although other suitable materials may also be utilized.

Figure 5:
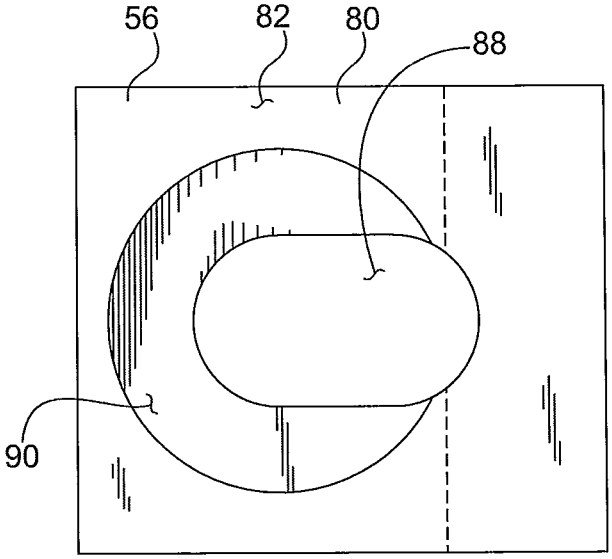
FIG. 5 is a top view of an insulated clip for a standard joint bar of the tie plate assembly shown in FIG. 1 according to one embodiment of the present invention.
Figure 6:
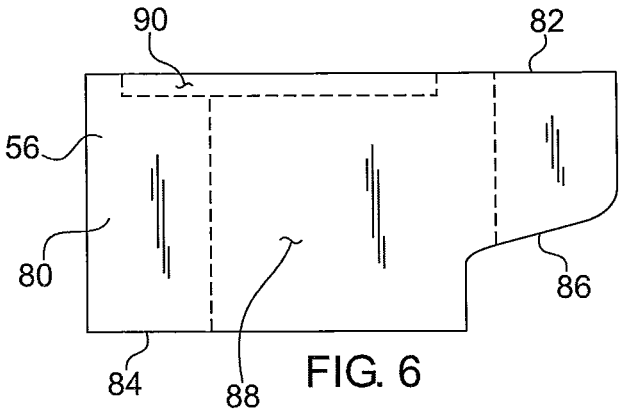
FIG. 6 is a side view of the insulated clip shown in FIG. 5.

Referring to FIGS. 5 and 6, the first clip 56 includes a clip body 80 having a top surface 82, a bottom surface 84, and an arcuate surface 86 configured to receive and engage a standard rail joint bar. The bottom surface 84 of the clip body 80 is configured to engage a top surface of the abutments 66, 68. The clip body 80 defines an elongated slot 88 that extends from the top surface 82 to the bottom surface 84 of the clip body 80. The clip body 80 also defines a counterbore 90 extending from the top surface 82 toward the bottom surface 84. The first clip 56 or at least the portion of the first clip 56 that is configured to contact the rail joint bar is manufactured from an electrically-insulating material, such as laminated fiberglass, polyurethane, ultra high molecular weight polyethylene (UHMWPE), rubber, a polymeric material containing reinforcing fibers, or any other suitable electrically-insulating material.

Figure 7:
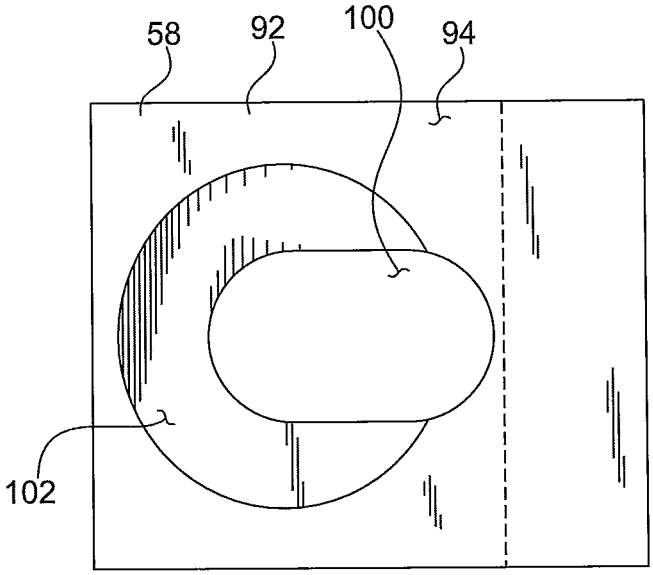
FIG. 7 is a top view of an insulated clip for a bonded joint bar of the tie plate assembly shown in FIG. 1 according to one embodiment of the present invention.
Figure 8:
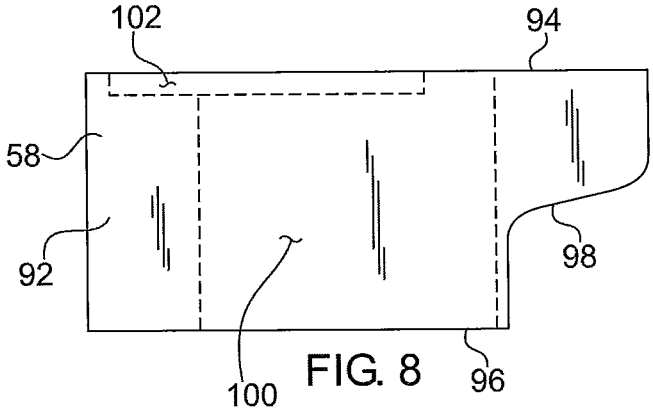
FIG. 8 is a side view of the insulated clip shown in FIG. 7.

Referring to FIGS. 7 and 8, the second clip 58 includes a clip body 92 having a top surface 94, a bottom surface 96, and an arcuate surface 98 configured to receive and engage a bonded rail joint bar. The bottom surface 96 of the clip body 92 is configured to engage a top surface of the abutments 66, 68. The clip body 92 defines an elongated slot 100 that extends from the top surface 94 to the bottom surface 96 of the clip body 92. The clip body 92 also defines a counterbore 102 extending from the top surface 94 toward the bottom surface 96. The second clip 58 or at least the portion of the second clip that is configured to contact the rail joint bar is manufactured from an electrically-insulating material, such as laminated fiberglass, polyurethane, UHMWPE, rubber, a polymeric material containing reinforcing fibers, or any other suitable electrically-insulating material.

Figure 9:
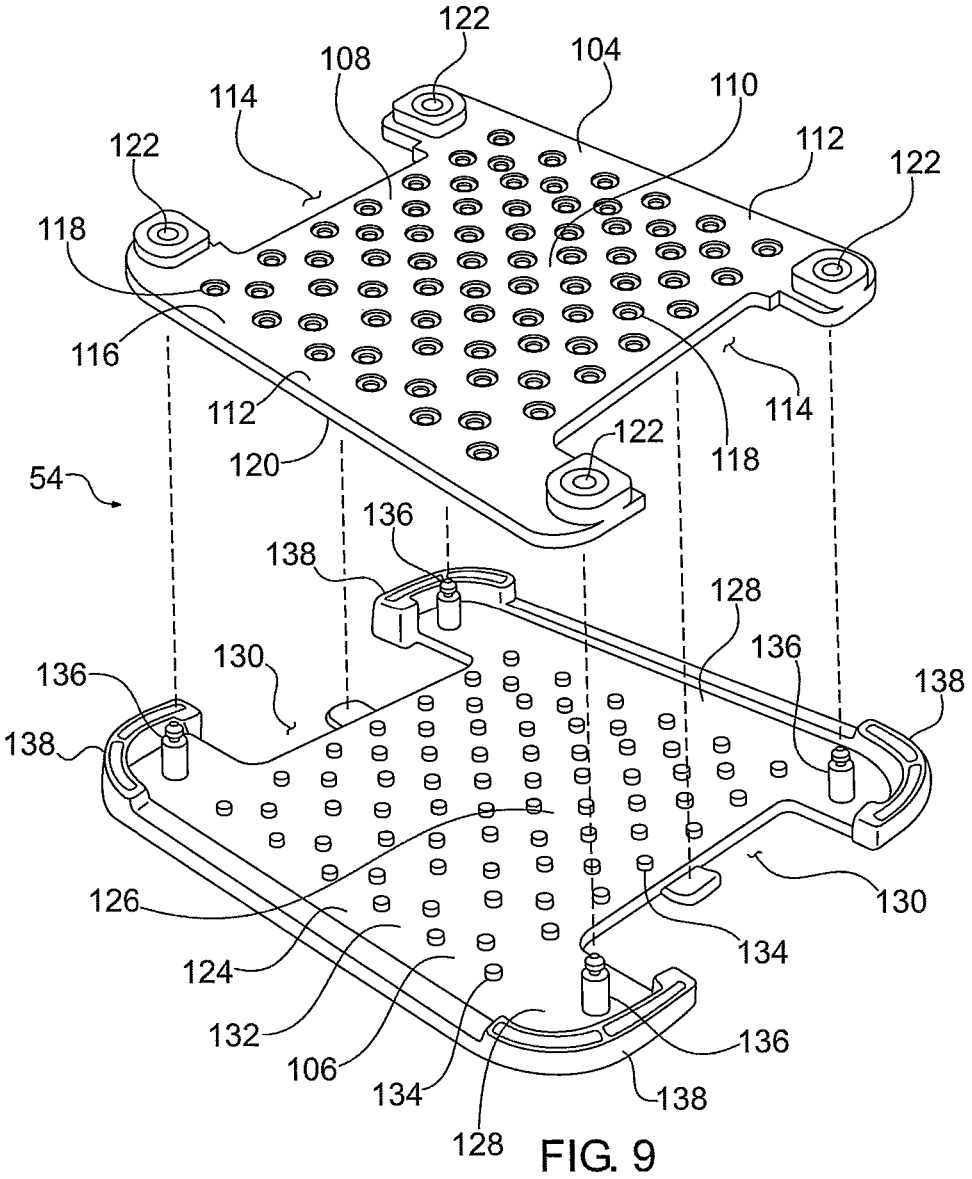
FIG. 9 is an exploded perspective view of an insulator plate assembly of the tie plate assembly shown in FIG. 1 according to one embodiment of the present invention.

Referring to FIG. 9, the insulator plate assembly 54 is embodied as an anti-abrasion pad assembly commercially available from Pandrol USA, 501 Sharptown Rd., PO BOX 367, Swedesboro, N.J. 08085. One embodiment of the insulator plate assembly 54 is shown in U.S. Pat. No. 7,690,584, which is hereby incorporated by reference in its entirety. The insulator plate assembly 54 includes a top pad 104 and an abrasion plate 106. The top pad 104 includes a generally H-shaped planar body 108 having a middle portion 110 and leg portions 112 that define a pair of recesses 114. A top surface 116 of the body 108 of the top pad 104 defines a plurality of circular dimples 118. A bottom surface 120 of the body 108 of the top pad 104 also defines a plurality of circular dimples (not shown) that are offset from the plurality of dimples 118 of the top surface 116. The leg portions 112 of the top pad 104 each define an opening 122. The abrasion plate 106 also includes a generally H-shaped planar body 124 having a middle portion 126 and leg portions 128 that define a pair of recesses 130. A top surface 132 of the body 124 of the abrasion plate 106 includes a plurality of protrusions 134 that are configured to be received by the plurality of dimples on the bottom surface 120 of the top pad 104. The leg portions 128 of the abrasion plate 106 include coupling posts 136 that are configured to be received within the openings 122 of the leg portions 112 of the top pad 104 to secure the top pad 104 to the abrasion plate 106 when joined together. The leg portions 128 of the abrasion plate 106 also each include arcuate-shaped wall portions 138. The top pad 104 and the abrasion plate 106 are each manufactured from a high impact plastic material, which is electrically-insulating, although other suitable materials may be utilized.

Referring again to FIGS. 2-9, in use, the tie plate 52 is secured to a rail tie (not shown) using a plurality of fasteners 140 that extend through the first and second sets of securing openings 72, 74. The receiving space 70 of the tie plate 52 receives the insulator plate assembly 54, which is received between the first and second abutments 66, 68. The middle portions 110, 126 of the top pad 104 and abrasion plate 106 of the insulator plate assembly 54 are received between the first and second abutments 66, 68 of the tie plate 52 with the leg portions 112, 128 of the top pad 104 and abrasion plate 106 generally extending along the sides 69 of the tie plate 52.

Figure 3:
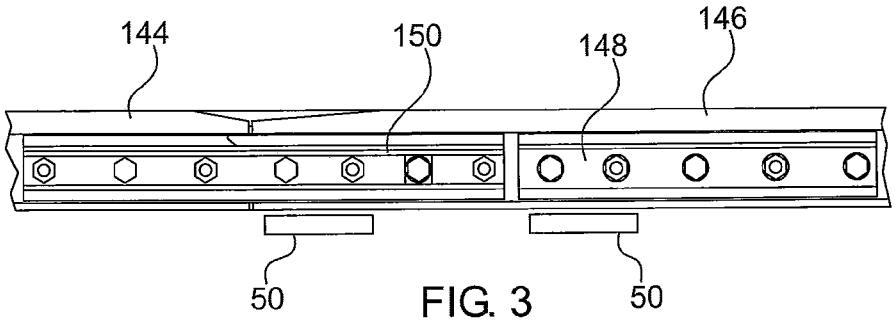
FIG. 3 is a front view of a rail joint assembly showing a location of the tie plate assembly of FIG. 2 according to one embodiment of the present invention.

The insulated plate assembly 54 and tie plate 52 receive a rail joint assembly 142. The rail joint assembly 142 includes first and second rail sections 144, 146 that are secured to each other via first and second rail joint bars 148, 150. More specifically, the rail joint assembly 142 is a lap joint rail arrangement as shown in U.S. Pat. No. 8,113,441, which is hereby incorporated by reference in its entirety. The first rail joint bar 148 is a standard rail joint bar and the second rail joint bar 150 is an offset or bent bonded joint bar. The rail joint assembly 142 includes, in total, two offset or bent bonded joint bars and two standard joint bars. The bonded joint bars are typically positioned opposite from the standard joint bar (i.e., on opposite sides of the rails) such that the first and second clips 56, 58 need to be different to accommodate the different joint bars. However, the rail joint assembly 142 may also utilize standard joint bars positioned opposite from standard joint bars and bonded joint bars positioned opposite from bonded joint bars such that two of the first clips 56 or two of the second clips 58 may be utilized to accommodate such an arrangement. Further, one or more tie plate assemblies 50 may be provided. In particular, as shown in FIG. 3, two tie plate assemblies 50 are provided with each tie plate assembly 50 being located between the fourth and fifth bolt from each end of the rail joint bars 148, 150. The tie plate assembly 50 may also be utilized with butt joint rail assemblies and rail joint assemblies that utilize two or more rail joint bars.

Referring to FIG. 2, the arcuate surface 86 of the first clip 56 engages the first rail joint bar 148 with a first clip fastener 152 securing the joined rails 144, 146 to the tie plate 52. In particular, the arcuate surface 86 of the first clip 56 engages a lower portion of the first rail joint bar 148 that is generally in contact with a base portion 154 of the rails 144, 146. The first clip fastener 152 extends through the elongated slot 88 of the first clip 56 and through the first clip opening 76 of the tie plate 52. Similarly, the arcuate surface 98 of the second clip 58 engages the second rail joint bar 150 with a second clip fastener 156 securing the joined rails 144, 146 to the tie plate 52. The second clip fastener 156 extends through the elongated slot 100 of the second clip 58 and through the second clip opening 78 of the tie plate 52. The first clip fastener 152 and the second clip fastener 156 are each embodied as a hex bolt, lock nut, and lock washer arrangement, although other suitable securing arrangements may be utilized. The insulator plate assembly 54 is not fixedly secured to the tie plate 52 and is maintained in position via engagement with the first and second abutments 66, 68 and the compressive force of the rails 144, 146 and clips 56, 58, although the insulator plate may be securely fastened to the tie plate 52 using any suitable fastening arrangement. Accordingly, the insulator plate assembly 54 is configured to be readily removed from the tie plate 52 to allow replacement of the insulator plate assembly 54 separately from the tie plate 52 if it becomes worn or damaged during use.

Figure 10:
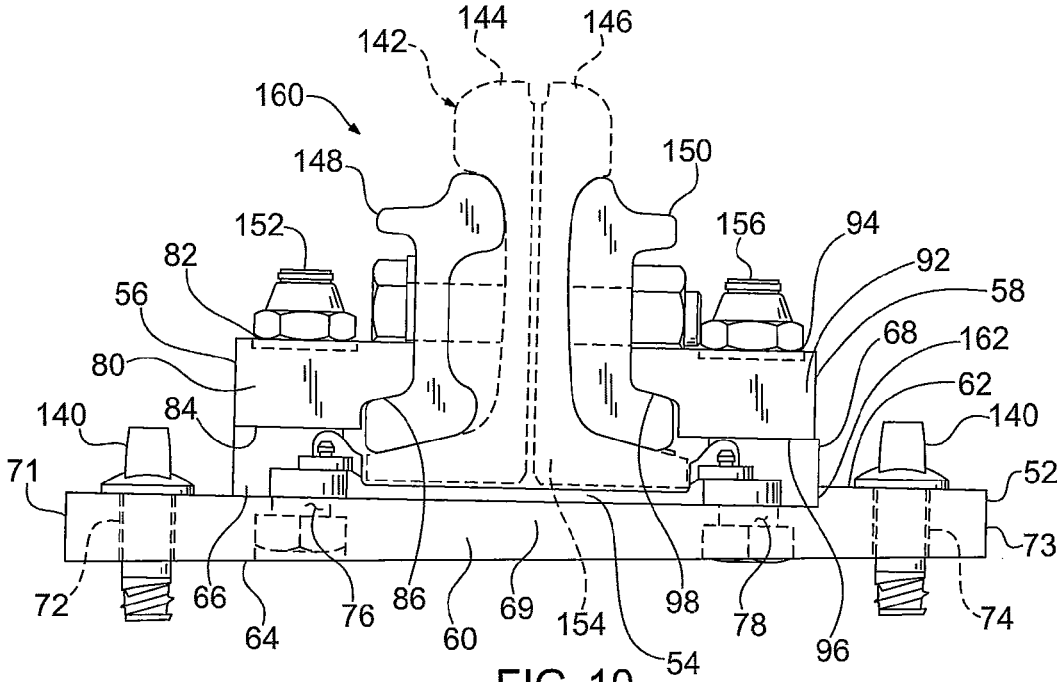
FIG. 10 is a side view of a tie plate assembly according to a further embodiment of the present invention.
Figure 11:
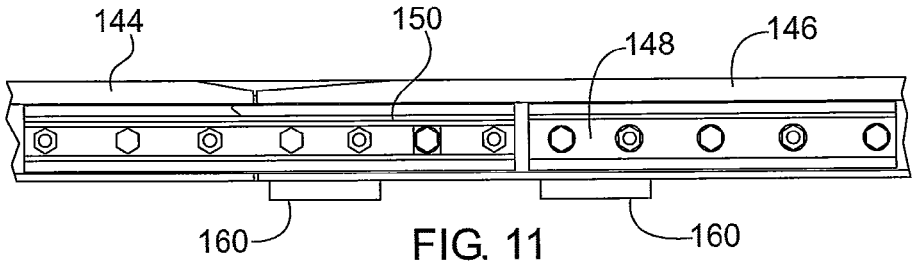
FIG. 11 is a front view of a rail joint assembly showing a location of the tie plate assembly of FIG. 9 according to one embodiment of the present invention.

Referring to FIGS. 10 and 11, a second embodiment of a tie plate assembly 160 is shown. The tie plate assembly 160 is similar to the tie plate assembly 50 shown in FIGS. 2-9, except that the top surface 62 of the tie plate 52 is canted and further includes a shoulder 162 adjacent to the second abutment 68. The shoulder 162 extends between the opposite sides 69 of the tie plate 52.

Figure 12:
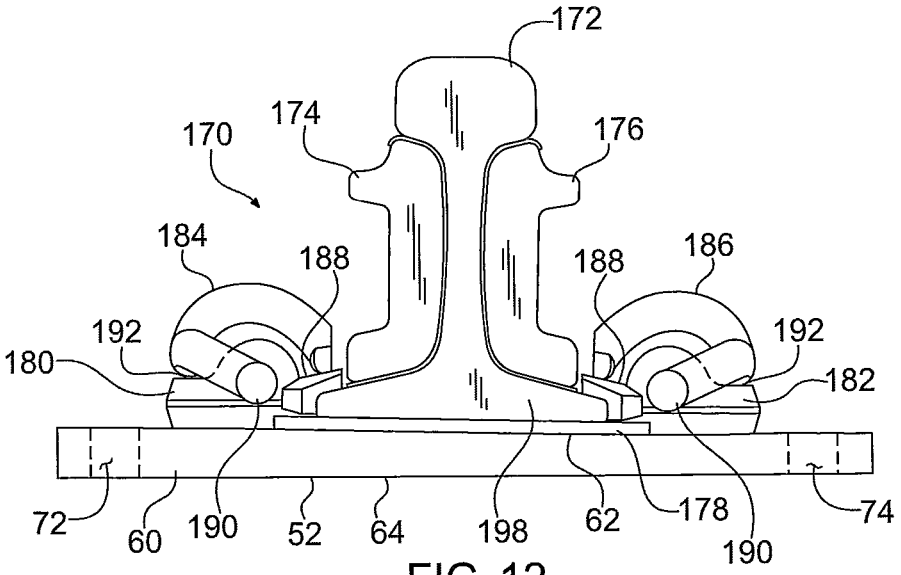
FIG. 12 is a side view of a tie plate assembly according to another embodiment of the present invention.
Figure 13:
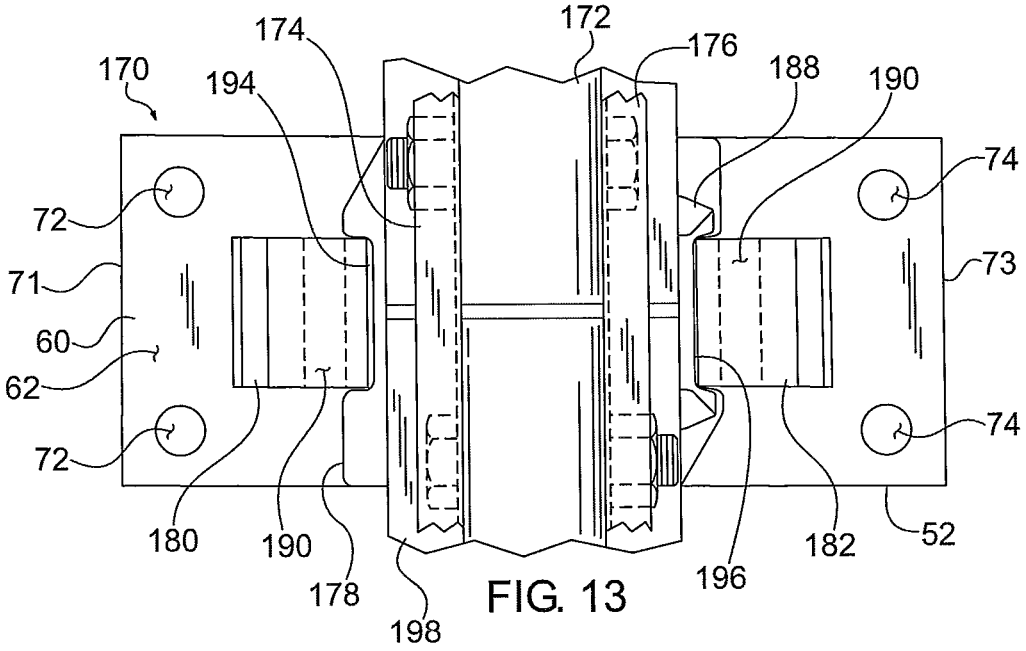
FIG. 13 is a top view of the tie plate assembly shown in FIG. 12.

Referring to FIGS. 12 and 13, a third embodiment of a tie plate assembly 170 is shown. The tie plate assembly 170 is similar to the tie plate assembly 50 shown in FIGS. 2-9. The tie plate assembly 170 of FIGS. 12 and 13, however, is utilized in connection with a butt joint (shown in FIG. 13) between adjoined rails 172 that includes first and second bonded joint bars 174, 176. An electrically-insulating end post is typically positioned between the adjoined rails 172 at the joint. Further, the tie plate assembly 170 utilizes a different insulator plate assembly 178, first and second abutments 180, 182, and first and second clips 184, 186. In particular, the first and second clips 184, 186 are Pandrol® E-clips with insulators 188 and the insulator plate assembly 178 is a rail pad and abrasion plate, which are all commercially available from Pandrol USA, 501 Sharptown Rd., PO BOX 367, Swedesboro, N.J. 08085. One embodiment of the insulator plate assembly 178 is shown in U.S. Pat. No. 5,110,046, which is hereby incorporated by reference in its entirety. The insulators 188 are modified from the stock arrangement by shortening the insulators 188 about 11/16" to accommodate the first and second bonded rail joint bars 174, 176, although other suitable length insulators 188 may also be utilized. The first and second abutments 180, 182 define transverse openings 190 and seats 192 to receive the Pandrol® clips 184, 186. The first and second abutments 180, 182 are also configured to receive the insulators 188 and insulator plate assembly 178. More specifically, the first and second abutments 180, 182 are received within recesses 194 of the generally H-shaped insulator plate assembly 178 and recesses 196 of the insulators 188. The insulators 188 are formed from an electrically-insulating material.

Referring again to FIGS. 12 and 13, the insulator plate assembly 178 is positioned between a base portion 198 of the adjoined rails 172 and the tie plate 52. The tie plate 52 is secured to a tie (not shown) using fasteners (not shown) in the same manner as discussed above in connection with the tie plate assembly 50 shown in FIGS. 2-9. The adjoined rails 172 are secured to the tie plate 52 using the Pandrol® clips 184, 186 and insulators 188 with the insulators 188 engaging the base portion 198 of the rails 172. The top surface 62 of the tie plate 52 is canted, although the tie plate 52 may be level or non-canted as well.

Accordingly, the tie plate assemblies 50, 160, 170 of FIGS. 2-13 secure adjoined rail sections to a tie plate while maintaining the electrical isolation between the respective rail sections. During extended use of the tie plate assemblies 50, 160, 170, the insulator plate assemblies 54, 178 may become worn and require replacement in the field. The tie plate assemblies 50, 160, 170 allow the insulator plate assemblies 54, 178 to be readily replaced and do not require the underlying tie plate 52 to be replaced as well. Further, railroads typically already maintain a large stock of the insulator plate assemblies 54, 178, which allows the railroads to quickly and readily replace the insulator plate assemblies 54, 178 with stock items that are familiar to the railroads. The insulator plate assemblies 54, 178 are typically utilized in connection with concrete railroad ties whereas the tie plate assemblies 50, 160, 170 are generally configured to utilize the insulator plate assemblies 54, 178 in connection with wooden railroad ties, although the tie plate assemblies 50, 160, 170 could also be utilized in connection with other types of ties. Although the insulator plate assemblies 54, 178 are generally H-shaped, the insulator plate assemblies 54, 178 may take other forms with the first and second abutments 66, 68, 180, 182 being configured to receive the insulator plate assemblies 54, 178 and still allow the insulator plate assemblies 54, 178 to be removed. The first and second clips 56, 58, 184, 186 may also be embodied as other types of clips to secure the rail sections to the tie plate 52. For example, the first and second clips 56, 58, 184, 186 may comprise Pandrol® FASTCLIPS, which move perpendicularly to the rail sections to secure the rail sections to a tie plate.

While several embodiments of a tie plate assembly were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A tie plate assembly comprising:

a tie plate having a body with a top surface, the tie plate including first and second abutments extending from the top surface of the tie plate, the first abutment spaced from the second abutment;

an insulator plate assembly positioned on the top surface of the tie plate, the insulator plate assembly comprising a top pad and an abrasive plate, the top pad received by and engaged with the abrasive plate, at least a portion of the insulator plate assembly positioned between the first and second abutments; and first and second clips configured to secure a rail to the tie plate assembly, the first and second clips comprising an electrically-insulating material.

2. The tie plate assembly of claim 1, further comprising a first clip fastener and a second clip fastener, wherein the first abutment and the first clip define a first clip opening for receiving the first clip fastener, and wherein the second abutment and the second clip define a second clip opening for receiving the second clip fastener.

3. The tie plate assembly of claim 2, wherein the first and second clips each comprise an arcuate surface configured to engage at least one of a standard rail joint bar and a bonded rail joint bar.

4. The tie plate assembly of claim 1, wherein the first clip is received by a top surface of the first abutment and the second clip is received by a top surface of the second abutment.

5. The tie plate assembly of claim 1, wherein the abrasive plate is configured to be received by the top surface of the tie plate, and wherein the abrasive plate is coupled to the top pad.

6. The tie plate assembly of claim 1, wherein the top pad and the abrasive plate each comprise an H-shaped body having a middle portion and a pair of legs, the middle portions of the top pad and the abrasive plate are received between the first and second abutments.

7. The tie plate assembly of claim 6, wherein the abrasive plate is configured to be received by the top surface of the tie plate, and wherein the abrasive plate is coupled to the top pad.

8. The tie plate assembly of claim 7, wherein the abrasive plate comprises a plurality of posts, and wherein the top pad comprises a plurality of openings, the plurality of openings of the top pad configured to receive the plurality of posts to couple the top pad to the abrasive plate.

9. The tie plate assembly of claim 1, wherein the first clip comprises an arcuate surface configured to engage a standard rail joint bar, and wherein the second clip comprises an arcuate surface configured to engage a bonded rail joint bar.

10. The tie plate assembly of claim 1, wherein the top surface of the tie plate is canted.

11. The tie plate assembly of claim 1, wherein the insulator plate assembly is configured to be movable relative to the tie plate.

12. A method of installing a tie plate assembly comprising:

positioning an insulator plate assembly on a top surface of a tie plate, the insulator plate assembly comprising a top pad and an abrasive plate;

positioning at least a portion of the top pad and the abrasive plate between first and second abutments extending from the tie plate; and securing first and second rail sections to the tie plate using first and second clips, the first and second clips comprising an electrically-insulating material.

13. The method of claim 12, wherein the top pad and the abrasive plate each comprise an H-shaped body having a middle portion and a pair of legs.

14. The method of claim 12, wherein the top pad and the abrasive plate each comprise an H-shaped body having a middle portion and a pair of legs.

15. The method of claim 12, wherein the insulator plate assembly is configured to be readily removed from the tie plate.

16. The method of claim 12, further comprising:

positioning the first clip on the first abutment and the second clip on the second abutment; and engaging a first rail joint bar with the first clip and engaging a second rail joint bar with the second clip.

17. The method of claim 16, wherein the first rail joint bar comprises a standard rail joint bar and the second rail joint bar comprises a bonded rail joint bar.

18. The method of claim 16, wherein the first clip and the second clip are secured to the tie plate via a fastener.

* * * * *